US005453769A

United States Patent [19]

Schantz et al.

[11] Patent Number: 5,453,769

[45] Date of Patent: Sep. 26, 1995

[54] PRINTHEAD AND A METHOD FOR THE MANUFACTURE THEREOF

[76] Inventors: Christopher A. Schantz, 939 Shell Blvd., Apt. 105, Foster City, Calif. 94404; Howard H. Taub, 1556 Eddington Pl., San Jose, Calif. 95129

[21] Appl. No.: 208,100

[22] Filed: Mar. 8, 1994

Related U.S. Application Data

[63] Continuation of Ser. No. 868,355, Apr. 2, 1992, abandoned.

[51] Int. Cl.[6] ..... B41J 2/05; B41J 2/16

[52] U.S. Cl. ..... 347/63; 347/47; 347/20; 29/890.1

[58] Field of Search ..... 347/63, 64, 65, 347/47, 20; 29/890.1

[56] References Cited

U.S. PATENT DOCUMENTS

| | | | |
|---|---|---|---|
| 3,626,143 | 12/1971 | Fry | 219/121.7 |
| 4,287,525 | 9/1981 | Tagawa | 346/139 C X |
| 4,314,259 | 2/1982 | Cairns | 346/75 |
| 4,996,585 | 2/1991 | Gruber | 357/74 |
| 5,008,496 | 4/1991 | Schmidt | 361/398 X |
| 5,103,375 | 4/1992 | Cottingham | 361/398 X |
| 5,305,015 | 4/1994 | Schantz | 347/47 |

FOREIGN PATENT DOCUMENTS

| | | | |
|---|---|---|---|
| 0352468A2 | 1/1990 | European Pat. Off. . | |
| 0471157A1 | 2/1992 | European Pat. Off. . | |
| 61-242852 | 10/1986 | Japan | B41J/3/04 |
| 2009049A | 6/1979 | United Kingdom . | |

*Primary Examiner*—Joseph W. Hartary

[57] ABSTRACT

An inkjet printhead including a flexible substrate having at least one fold therein such that a first section of the substrate overlies a second section of the substrate. Inkdrop ejection chambers are disposed between opposed surfaces of the first and second sections of the substrate. Ink inlet orifices are provided in the first section of the substrate and each of the ink inlet orifices are in fluid communication with a respective one of the inkdrop ejection chambers. Ink outlet apertures are provided in the second section of the substrate and each of the ink outlet apertures are in fluid flow communication with a respective one of the inkdrop ejection chambers.

17 Claims, 4 Drawing Sheets

PRINTHEAD AND A METHOD FOR THE MANUFACTURE THEREOF

This is a continuation of application Ser. No. 07/868,355 filed on Apr. 2, 1992, now abandoned.

BACKGROUND OF THE INVENTION

1. Field of the Invention

The present invention generally relates to printheads for inkjet printers.

2. State of the Art

FIG. 1 shows an example of a conventional printhead for a thermal inkjet printer. The printhead includes a substrate 1, an intermediate layer 2, and an orifice plate 3. A nozzle 4 is formed in the orifice plate, and a vaporization cavity 5 is defined between the substrate and the orifice plate. For convenience of illustration, the drawing shows only one of the nozzles in the orifice plate; however, a complete inkjet printhead includes an array of circular nozzles, each of which is paired with a vaporization cavity. Moreover, a complete inkjet printhead includes channels that connect vaporization cavities to an ink supply.

Furthermore, in a complete printhead, each vaporization cavity includes a heater resistor such as the resistor 6 in FIG. 1. In practice, the heater resistors on a printhead are connected in an electrical network for selective activation. When a particular heater resistor receives a pulse, the electrical energy is rapidly converted to heat which then causes ink adjacent to the heater resistor to form a vapor bubble 7. As the vapor bubble expands due to the heat provided by an energized heater resistor, the bubble ejects a droplet of ink from the nozzle in the orifice plate. This action is schematically illustrated in FIG. 1 with the direction of bubble growth being indicated by the arrow. By appropriate selection of the sequence of energizing the heater resistors, the ejected ink droplets can form patterns such as alphanumeric characters.

In practice, the quality of print provided by inkjet printers depends upon the physical characteristics and relative positioning of the ink ejection nozzles, resistors, vaporization cavities and ink inlet channels. More particularly, the design of these elements in a printhead determine the size, trajectory, frequency response and speed of ink drop ejection. In some instances, geometry can affect the ejection of ink from adjacent nozzles crosstalk.

There are several shortcomings to conventional processes for fabricating inkjet printheads. One shortcoming is that an accurate positioning step is required as the nozzle plate is assembled together with the substrate. This positioning step is costly because of the time and expensive equipment required. A further shortcoming of conventional processes occurs during the temperature cycling which a printhead experiences during use. This cycling sets up stresses and strains in the assembly since the nozzle plate and substrate have differing coefficients of thermal expansion. These stresses and strains can cause delamination of the part under extreme cases.

SUMMARY OF THE INVENTION

Generally speaking, the present invention provides a printhead that includes a flexible substrate having at least one fold therein such that a first section of the substrate can be folded to overlie a second section of the substrate. A printhead according to the present invention combines the advantages of printheads comprising flexible, extendible substrates wherein the resistors and orifices are provided on the same section of a substrate with the efficiency and layout advantages of printheads wherein the resistor substrate and orifice plate are separate parts. That is, more space is available to lay out resistors and conductors and the arrangement has higher drop ejection efficiency than the arrangement wherein the resistors and orifices are provided on the same section of a substrate.

In a preferred embodiment of the present invention, a plurality of drop ejection chambers are disposed between opposed surfaces of the first and second sections of the substrate, a plurality of ink inlet orifices are provided in the first section of the substrate and each of the ink inlet orifices are in fluid communication with a respective one of the drop ejection chambers. A plurality of ink outlet apertures can be provided in the second section of the substrate with each of the ink outlet apertures in fluid communication with a respective one of the drop ejection chambers and a bulk ink supply can be provided in direct fluid communication with each of the ink inlet orifices. The flexible substrate can also include at least two folds therein such that a third section of the substrate overlies at least one of the first and second sections.

The fold means can comprise a row of spaced-apart perforations in the substrate, a slot or slots extending only part way through the substrate, or a weakened portion of the substrate which allows the substrate to be folded such that the first section of the substrate on one side of the weakened portion overlies the second section on an opposite side of the weakened portion. As the part is folded or sometime thereafter, the sections are permanently adhered to each other to form a single structure. The means employed to adhere the parts can make use of heat, pressure, UV light or other means to cure a glue layer before folding. Alternatively with the proper choice of materials and curing means either the substrate or barrier material may also be utilized as the adhesive.

BRIEF DESCRIPTION OF THE DRAWINGS

The present invention can be further understood with reference to the following description in conjunction with the appended drawings, wherein like elements are provided with the same reference numerals. In the drawings.

DETAILED DESCRIPTION OF PREFERRED EMBODIMENTS

Figure 1:
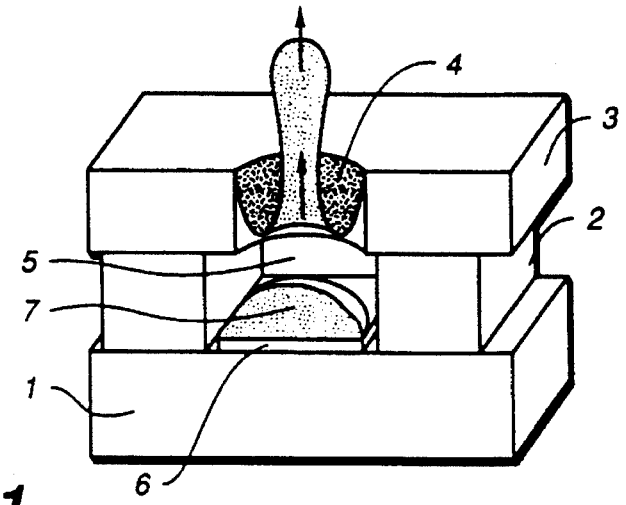
FIG. 1 (PRIOR ART)
FIG. 1 is a cross-sectional view of a portion of a conventional inkjet printhead.
Figure 2:
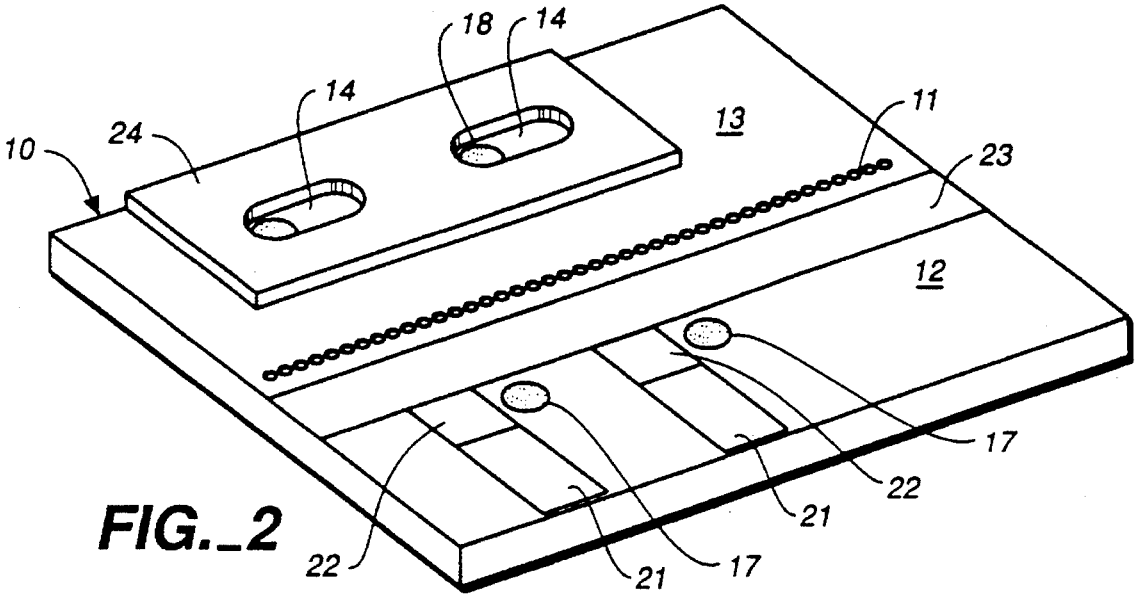
FIG. 2 is a pictorial view of a printhead according to one embodiment of the present invention.

As shown in FIG. 2, a printhead of a thermal inkjet printer includes a flexible substrate 10 having at least one fold means 11 that allows a first section 12 of the substrate 10 to be folded over a second section 13. The fold means 11 can comprise spaced-apart perforations that extend completely through the substrate (FIG. 2) or, alternatively, spaced-apart slot-like depressions or apertures that extend only partway through the substrate. The perforations or depressions can have circular, diamond, hexagonal or other shapes that promote hinge formation along a predetermined straight line. For example, the perforations can comprise 100 μm diameter apertures with their centers spaced about 150 μm apart. As another example, the perforations can have elongated hexagonal shapes that have a length of 200 μm and an aspect ratio of about 3:1 with centers about 250 μm apart. In the preceding example, when the apertures are formed in a flexible substrate consisting of the polyimide material known as "UPILEX" in thicknesses ranging from 2 to 5 mils, as the fold is made, one surface of the substrate fractures while the other remains unbroken and forms a hinge that connects the sections together. This effect is not requisite for the hinge means to be successful and may not occur with other materials and fold means.

Figure 3:
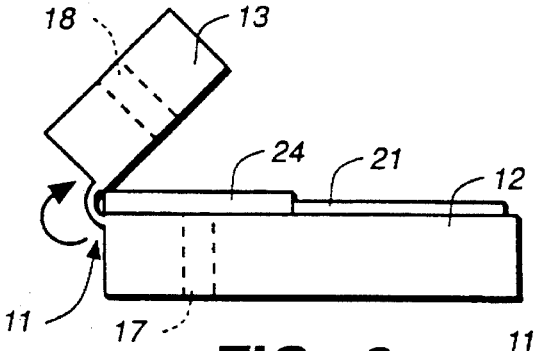
FIGS. 3 and 4 show the printhead of FIG. 2 being folded.
Figure 4:
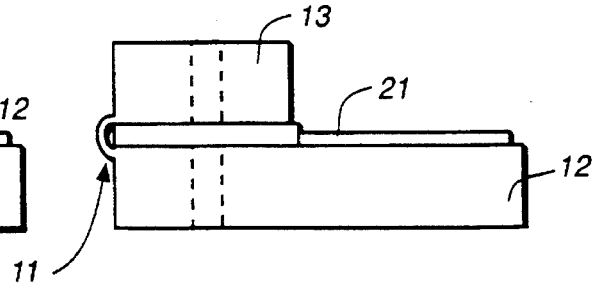

With the fold means 11 formed as described above, the two substrate sections can be folded to overlie each other as shown in FIGS. 3 and 4. The resulting structure can be said to be monolithic because both the substrate and the orifice plate are formed of the same material.

Preferably, the substrate 10 comprises a polymer material ranging in thickness from about 1 to 5 mils. The polymer can comprise a plastic such as polyimide, teflon, polyamide, polymethylmethacrylate, polyethyleneterephthalate (PET) or mixtures thereof. For such substrates, the fold means 11 preferably is fabricated by laser ablation, using an excimer laser.

As also shown in FIG. 2, at least one inkdrop ejection chamber 14 is formed on the surface of the substrate section 13, and at least one ink inlet aperture 17 is formed through the substrate section 12. It should be noted that the ink inlet aperture 17 is positioned to be in fluid communication with the inkdrop ejection chamber 14 when the two sections 12, 13 are folded over each other as shown in FIGS. 3 and 4.

As further shown in FIG. 2, at least one ink outlet orifice 18 is formed through second substrate section 13, i.e., on the side of the fold means 11 opposite the laser ablated ink inlet apertures 17. Again, as shown in FIG. 3 and 4, the ink outlet orifice 18 is located to be in fluid flow communication with the inkdrop ejection chamber 14 when the first and second sections are folded over each other.

When photo-ablating the fold means 11, the ink inlet apertures 17, the ink outlet apertures 18, and the perforations for the fold means 11 can be formed at the same time. In practice, this is done by using a suitable mask and a single flood exposure to laser energy. Normally, thin film resistors 22 are formed on substrate 10 prior to forming the apertures; thus, when the mask has been aligned relative to the resistors, all of the apertures formed by the exposure through the mask will be in proper alignment.

Finally as shown in FIG. 2, thin film conductor lines 21, a thin film common conductor line 23 and a barrier means 24 are formed on substrate 10. Preferably, the resistors 22 and the outlet apertures 18 are located such that the fold means 11 is spaced substantially from the thin film areas. Also it is preferred that the barrier means 24 is fabricated as a dry film barrier; alternatively, however, the barrier means can comprise a photo-ablated region on the substrate 10. In either case, the inkdrop ejection chamber 14 is defined by the barrier means 24.

It should be understood that the above-described folded assembly can be connected to an inkjet pen body either with the resistors 22 facing towards or away from the pen body. When assembled with the resistors facing the pen body, the ink inlets can be used as ink outlets and the ink outlets can be used as ink inlets. In other words, depending on the orientation of the folded assembly, the orifices 17 and 18 can be used interchangeably as ink inlets or ink outlets.

Figure 5:
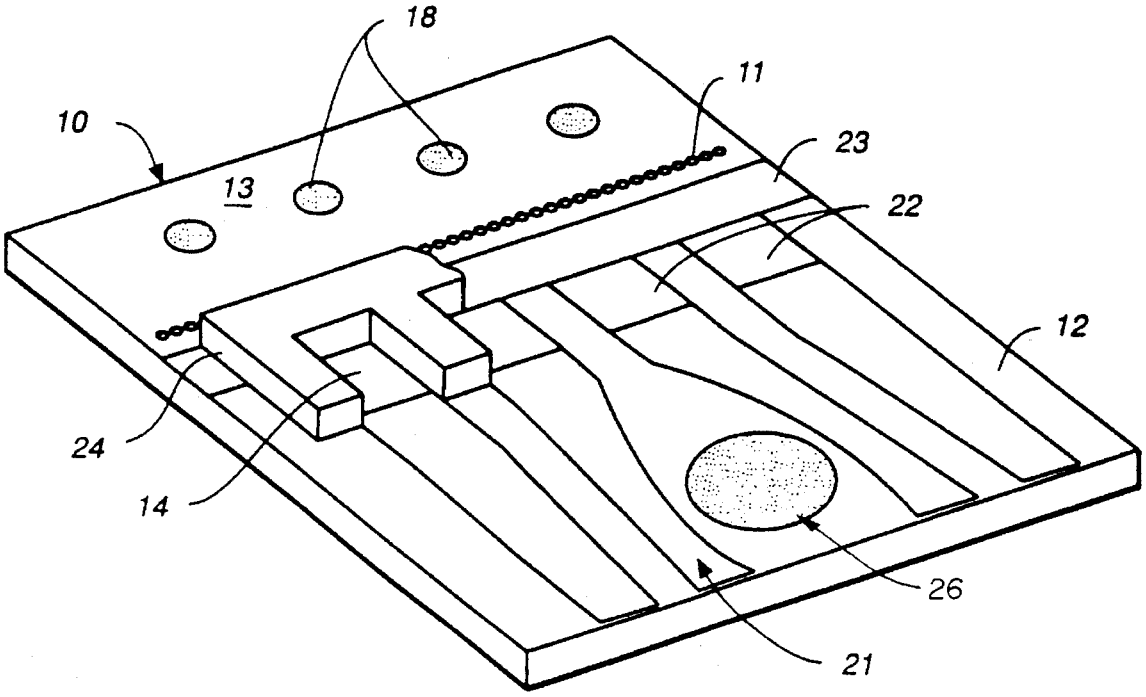
FIG. 5 is a pictorial view of a printhead according to a second embodiment of the invention.

In an alternative embodiment shown in FIG. 5, the substrate 10 includes a first section 12 including resistors 22 and a second section 13 including outlet apertures 18. The substrate 10 is foldable along the fold means 11 such that the outlet apertures 18 register with the resistors 22. In this embodiment, a single ink inlet aperture 26 supplies ink to more than one inkdrop ejection chamber. The barrier means is utilized to define the ink ejection chamber as before and also to define a common ink manifold area. The conductor lines 21 and common conductor 23 complete the electrical means for heating the resistors 22.

In the general case, more than two fold means can be used to form additional sections which can be folded over each other. For example, in the embodiment shown in FIGS. 6 and 7, the flexible substrate 10 includes a second fold means 19 that defines a third section 20 of the substrate 10. More particularly, in this embodiment, the first fold means 11 separates sections 13 and 20 of the substrate 10, and the second fold means 19 separates the sections 20 and 12. The first section 12 includes ink inlets 17 and resistors 22, the second section 13 includes ink outlets 18, and the third section 20 includes inkdrop ejection chambers 14.

Figure 6:
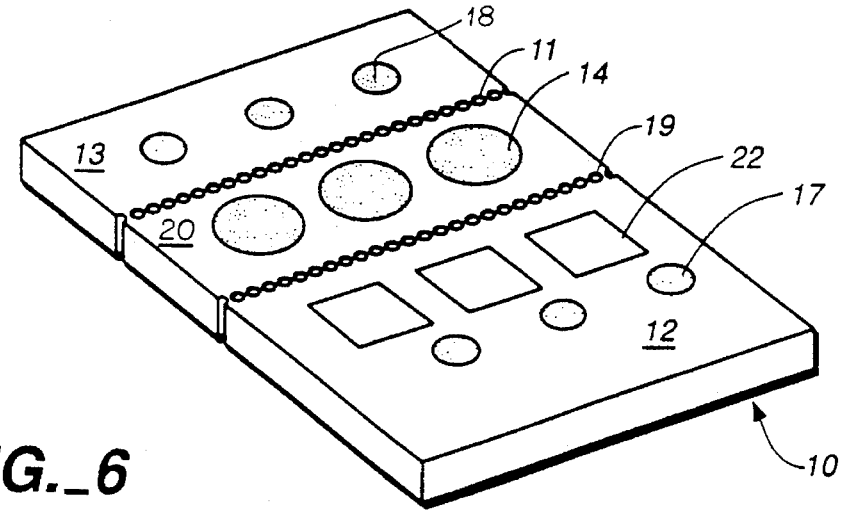
FIG. 6 is a pictorial view a printhead according to a third embodiment of the invention.
Figure 7:
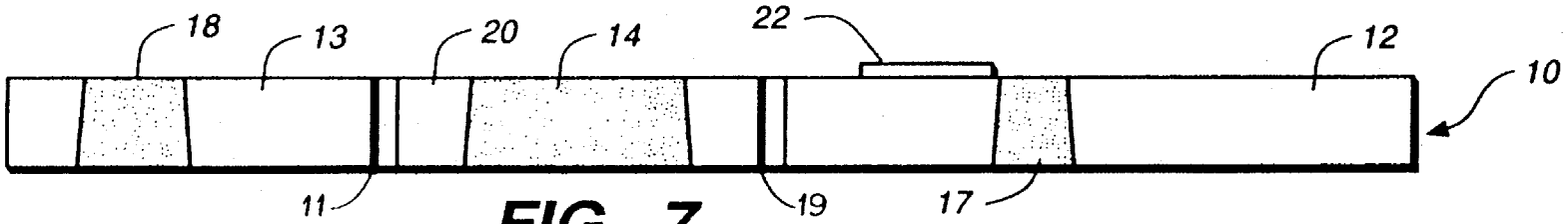
FIG. 7 is a side sectional view of the printhead of FIG. 6.
Figure 9:
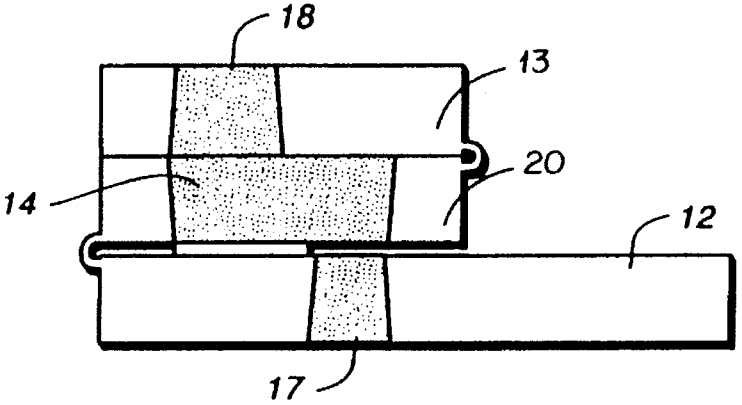
FIGS. 8 and 9 show the printhead of FIGS. 6 and 7 being folded.
Figure 8:
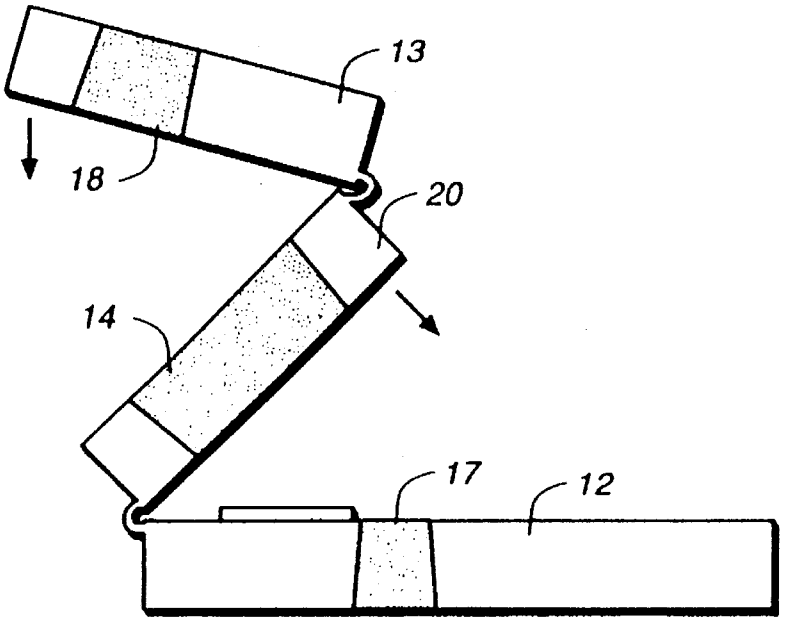

The structure in FIGS. 6 and 7 can be folded in various ways to form a monolithic inkjet printhead. For instance, as shown in FIGS. 8 and 9, the section 13 can be folded to overlay the third section 20 with the third section 20 being between the first and second sections 12, 13. It may be noted that, prior to folding, the third section 20 is between the first and second sections 12, 13.

Figure 10:
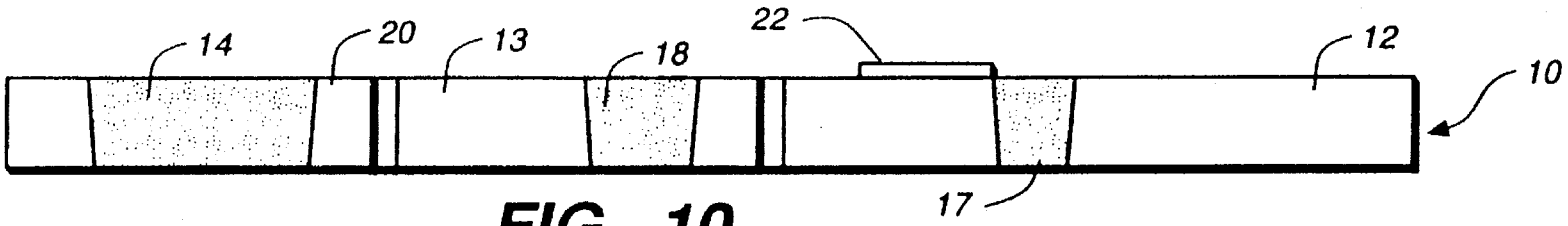
FIGS. 10–12 show a variation of the third embodiment and how it is folded to form a monolithic assembly.
Figure 12:
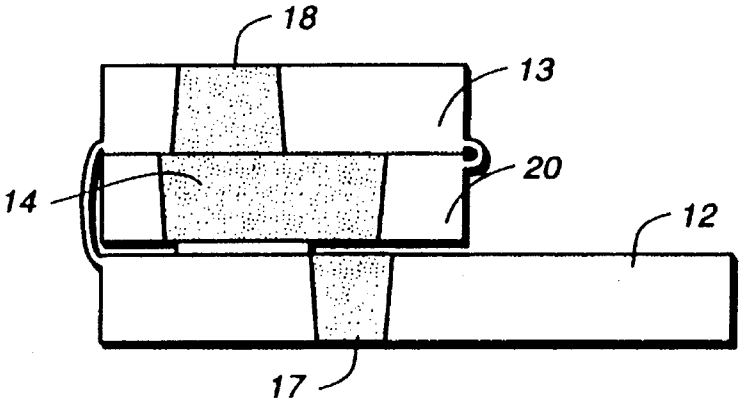
Figure 11:
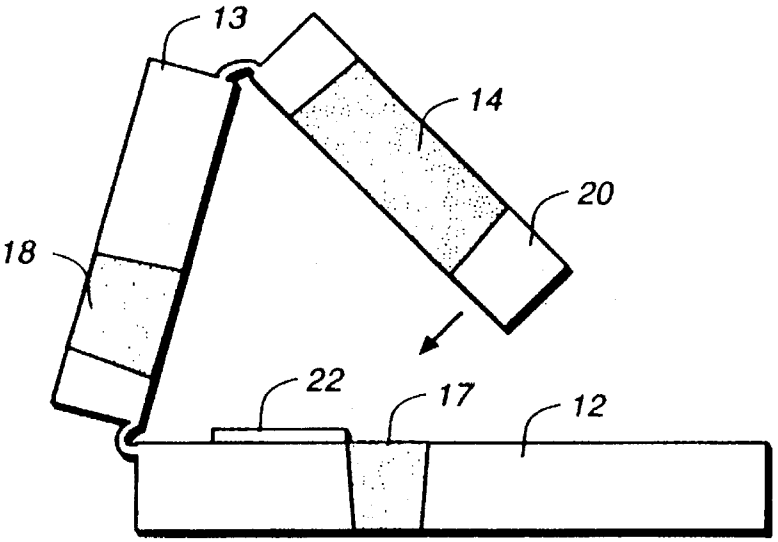

In the embodiment in FIG. 10, the second section 13 is located between the third and first sections 20, 12 prior to folding the substrate 10. In the folded assembly, as shown in FIGS. 11 and 12, the substrate 10 is folded such that the third section 20 fits between the first and second sections 12, 13.

Although the foregoing has described the principal preferred embodiments and modes of operation of the present invention, the invention should not be construed as being limited to the particular embodiments discussed. For example, the fold means 11 can be formed by electroforming techniques applied to metals rather than laser ablation of plastic materials. As another example, the above-described methods can be employed for fabricating various devices, other than inkjet printheads, where it is important the components be carefully aligned in relationship to each other and where it would be beneficial to form the components on a single substrate.

Thus, with the foregoing example and others in mind, it should be understood that the above-described embodiments should be regarded as illustrative rather than restrictive, and it should be appreciated that variations may be made in those embodiments by workers skilled in the art without departing from the scope of the present invention as defined by the following claims.

What is claimed is:

1. A printhead of an inkjet printer comprising:

a substrate having at least one fold means therein such that a first section of the substrate having an orifice therein can be folded to overlay a second section of the substrate; and the fold means and the orifice being formed at the same time so as to provide proper alignment therebetween.

2. The printhead of claim 1 wherein:

the substrate comprises a polymer material; and the fold means comprises a portion of the substrate which is at least partially perforated by photoablation.

3. The printhead of claim 1, further comprising:

a plurality of inkdrop ejection chambers that are disposed between opposed surfaces of the first and second sections of the substrate;

a plurality of ink inlet orifices in the first section of the substrate with the ink inlet orifices in fluid communication with the inkdrop ejection chambers;

a plurality of ink outlet apertures in the second section of the substrate with each of the ink outlet apertures in fluid communication with a respective one of the inkdrop ejection chambers; and ink supply means in direct fluid communication with each of the ink inlet orifices;

such that the fold means, the inlet orifices and the outlet apertures are formed at the same time so as to provide proper alignment therebetween.

4. A printhead for an inkjet printer comprising:

a substrate extending in a longitudinal direction;

at least one inkdrop ejection chamber on a chamber section of the substrate, the inkdrop ejection chamber being located at a first position on the substrate;

at least one orifice in an orifice section of the substrate, the orifice being located at a second position on the substrate;

first fold means for forming a fold in the substrate whereby the substrate can be folded with the chamber section and the orifice section placed in a precise predetermined relationship to one another;

second fold means for forming a second fold in the substrate that allows another section of the substrate to be folded over the chamber section and the orifice section; and at least one resistor disposed on the substrate and located in the inkdrop ejection chamber when the substrate is folded.

5. The printhead of claim 4, further comprising a barrier means that defines the inkdrop ejection chamber, with the barrier means comprising a dry film barrier and the resistor being disposed in the inkdrop ejection chamber defined by the barrier means after the first and second sections are folded over one another.

6. The printhead of claim 4, wherein the inkdrop ejection chamber comprises a photo-ablated region extending at least part way through the substrate.

7. The printhead of claim 6, wherein the photo-ablated region forms an opening extending completely through the substrate.

8. The printhead of claim 4, wherein the orifice comprises an outlet aperture, the substrate further including at least one inlet orifice, the second fold means being located between the inlet orifice and the outlet aperture.

9. The printhead of claim 4 further comprising a bulk ink supply and the substrate further includes a plurality of ink inlet orifices which are in direct fluid communication with the bulk ink supply.

10. A method of forming an inkjet printhead, comprising the steps of:

(a) providing at least one thin film resistor on a flexible substrate;

(b) providing conductor means on the substrate for electrically heating the resistor;

(c) forming at least one inkdrop ejection chamber on the substrate;

(d) forming at least one orifice in the substrate and a weakened portion of the substrate at the same time so as to provide proper alignment therebetween; and (e) folding the substrate at the weakened portion to form a folded monolithic assembly with the resistor located in the inkdrop ejection chamber and the orifice in fluid communication with the inkdrop ejection chamber.

11. The method of claim 10, wherein the orifice comprises an ink outlet aperture, the method further comprising a step (f) of forming at least one ink inlet orifice in the substrate, the inlet orifice being in fluid communication with the inkdrop ejection chamber when the substrate is folded in step (e).

12. The method of claim 11, wherein the substrate comprises a polymer material and the steps (d) and (f) of forming the outlet aperture, the weakened portion and the inlet orifice are performed simultaneously by photo-ablating the polymer material by exposing the substrate to laser energy passed through a mask.

13. The method of claim 12, further comprising a step (f) of attaching a bulk ink supply to the folded monolithic assemble with the ink inlet orifice in direct fluid communication with the bulk ink supply.

14. A method for fabricating a device on a single substrate, the method comprising:

(a) forming at the same time an orifice and a weakened portion on the substrate so as to provide proper alignment therebetween; and (b) folding the substrate at the weakened portion to form a folded monolithic assembly.

15. The method of claim 14 wherein:

the step of forming includes forming at least two more components;

such that the components are to be precisely aligned in a predeterminable relationship; and when the substrate is folded at the weakened portion, at least two of the components are aligned in superposed relationship, one above another.

16. The method of claim 14 wherein:

the substrate comprises a polymer material; and the step of forming is performed by photo-ablation.

17. A printhead for an inkjet printer comprising:

a substrate extending in a longitudinal direction;

at least one inkdrop ejection chamber on a chamber section of the substrate, the inkdrop ejection chamber being located at a first position on the substrate;

at least one orifice in an orifice section of the substrate, the orifice being located at a second position on the substrate;

first fold means for forming a fold in the substrate whereby the substrate can be folded with the chamber section and the orifice section placed in a precise predetermined relationship to one another;

second fold means for forming a second fold in the substrate that allows another section of the substrate to be folded over the chamber section and the orifice section; and at least one resistor disposed on the substrate and located in the inkdrop ejection chamber when the substrate is folded.

* * * * *